US006394748B1

(12) United States Patent
Rietschle et al.

(10) Patent No.: US 6,394,748 B1
(45) Date of Patent: May 28, 2002

(54) MULTI-STAGE SIDE CHANNEL PUMP

(75) Inventors: Werner Rietschle, Schopfheim; Markus Britsche, Efringen-Kirchen, both of (DE)

(73) Assignee: Werner Rietschle GmbH + Co. KG, Schopfheim (DE)

( * ) Notice: Subject to any disclaimer, the term of this patent is extended or adjusted under 35 U.S.C. 154(b) by 0 days.

(21) Appl. No.: 09/486,059

(22) PCT Filed: Aug. 21, 1998

(86) PCT No.: PCT/EP98/05338

§ 371 (c)(1),
(2), (4) Date: Feb. 22, 2000

(87) PCT Pub. No.: WO99/10656

PCT Pub. Date: Mar. 4, 1999

(30) Foreign Application Priority Data

Aug. 22, 1997 (DE) ..... 197 36 678

(51) Int. Cl.[7] ..... F04D 29/42

(52) U.S. Cl. ..... 415/55.6; 415/199.1; 415/204; 415/206; 415/211.2

(58) Field of Search ..... 415/55.5, 55.6, 415/198.1, 199.1, 203, 204, 206, 211.2, 214.1

(56) References Cited

U.S. PATENT DOCUMENTS

| | | | | |
|---|---|---|---|---|
| 3,324,799 A | | 6/1967 | Terrano | |
| 3,385,225 A | * | 5/1968 | Hagermann | 415/143 |
| 3,518,021 A | | 6/1970 | Lake | |
| 4,204,800 A | * | 5/1980 | Bentele et al. | 415/55.5 |
| 4,325,672 A | | 4/1982 | Sixsmith | |
| 5,147,179 A | * | 9/1992 | Bransch | 415/168.2 |
| 5,295,784 A | * | 3/1994 | Grotz | 415/55.6 |
| 5,605,443 A | * | 2/1997 | Schoning et al. | 415/214.1 |

FOREIGN PATENT DOCUMENTS

| | | | |
|---|---|---|---|
| DE | 733 758 C | | 4/1943 |
| DE | 868 956 C | | 3/1953 |
| DE | 19 31 681 A | | 1/1971 |
| DE | 27 21 233 B | | 7/1978 |
| EP | 0 346 720 A | | 12/1989 |
| FR | 2 294 114 A | | 7/1976 |
| GB | 2134598 A | * | 8/1984 |
| JP | 61 142391 A | | 6/1986 |

* cited by examiner

*Primary Examiner*—Edward K. Look
*Assistant Examiner*—Ninh Nguyen
(74) *Attorney, Agent, or Firm*—Nixon Peabody LLP; Stuart J. Friedman

(57) ABSTRACT

In a multi-stage side channel pump, the efficiency can be optimized in that the geometry of each subsequent stage (14) is adapted to the specific volume of the medium at the outlet of the preceding stage (12) by determining the dimensions of the impeller diameter (D) and of the flow channel diameter (d). The stage pressure is the same for both stages (12, 14). The impeller geometry of the next stage (14) is determined by means of the volume ratio of the preceding stage (12) to the next stage (14), assuming geometric similarity.

11 Claims, 6 Drawing Sheets

26
28
14b
12a
12b
14a
42
40
A
B
C
D
E
F
H
J
K

MULTI-STAGE SIDE CHANNEL PUMP

FIELD OF THE INVENTION

The invention relates to a multi-stage side channel pump (or periphery pump) that is used to compress compressible media and whose impellers are coupled to a shared drive shaft.

BACKGROUND OF THE INVENTION

In the case of multi-stage side channel pumps, the impellers of several stages, usually two stages, are normally attached next to each other on a shared drive shaft. The only constructions commonly available are those in which the impellers of two adjacent stages have the same geometry and size. The inlet of the subsequent stages is normally connected directly with the outlet of the preceding stage inside a shared housing.

German utility model no. 7,441,311 discloses a compressor configuration in which several impellers having different widths are arranged next to each other on a shared drive shaft. Each of the appertaining impellers is to be driven individually, coupled in parallel or else combined in a serial connection.

SUMMARY OF THE INVENTION

However, all of the known multi-stage side channel pumps have in common the fact that they generally do not attain optimum efficiency.

The invention provides a multi-stage side channel pump that entails optimized efficiency. According to the invention, this is achieved in that the geometry of each stage is adapted to the specific volume of the medium by determining the dimensions of the impeller and of the flow channel diameter. As a result, each subsequent stage is dimensioned altogether smaller than the preceding stage. Since the impellers of both stages rotate at the same speed, in the next stage, the pressure differential between the inlet and outlet is the same as in the stage that precedes it.

In calculating the geometry of a subsequent stage or of several subsequent stages, preferably the following approach is taken: first of all, the stage pressure p is calculated for each stage on the basis of the required final pressure and of the number of stages, according to the following relationship:

$$p=(p_{final})^{1/n}$$

wherein p stands for the stage pressure;

$p_{final}$ stands for the required final pressure;

n is the number of stages of a multi-stage side channel pump.

Then, the impeller geometry of the next stage is determined by means of the volume ratio of the preceding stage to the next stage, assuming geometric similarity. This volume ratio can be derived from the relationship for the adiabatic curve:

$$p\cdot V^K=\text{constant}.$$

By taking $V_1$ and $P_1$ for the volume and pressure of the first stage and $V_2$ and $P_2$ for the volume and pressure of the second stage, the following results:

$$P_1\cdot V_1^K=P_2\cdot V_2^K$$

or $$\frac{V_2}{V_1}=\left(\frac{P_1}{P_2}\right)^{1/K}.$$

If, for example, in the case of a three-stage side channel pump, the required final pressure is 2.2 bar (abs.), the result is a stage pressure $p=(2.2)^{1/3}=1.3$ bar (abs).

The following applies to the volume ratio:

$V_2/V_1=0.829$, whereby the value 1.4 (diatomic gas) is taken for the adiabatic exponent K.

This ratio of 0.829 is then used to calculate the impeller geometry, assuming geometric similarity over the dimensionless characteristic line $\Psi=f(\Phi_K)$.

When the side channel pump according to the invention is configured with two stages, both stages are preferably integrated into one modular unit having a shared drive motor, and the impellers of both stages are attached to the shared drive shaft. If there are more than two stages, the stages are preferably lined up in a modular configuration. A particularly advantageous embodiment is one in which each pair of stages is combined in a housing to form a structural component and the impellers are attached to a shared shaft segment; the housing of one of the structural components is flanged onto the shared drive unit while another structural component, in turn, is flanged onto the first structural component, whereby the shaft segments of the structural components are each coupled to each other or to the drive shaft of the drive unit by a coupler.

Another advantageous embodiment of the invention consists in that the inlets and outlets of the stages lead to the outside separately. In this manner, the stages can be freely combined with each other or else operated separately from each other.

BRIEF DESCRIPTION OF THE DRAWINGS

Additional characteristics and advantages of the invention ensue from the description below of several embodiments as well as from the drawing, to which reference is made. The drawing shows the following.

DESCRIPTION OF THE PREFERRED EMBODIMENT

Figure 1:
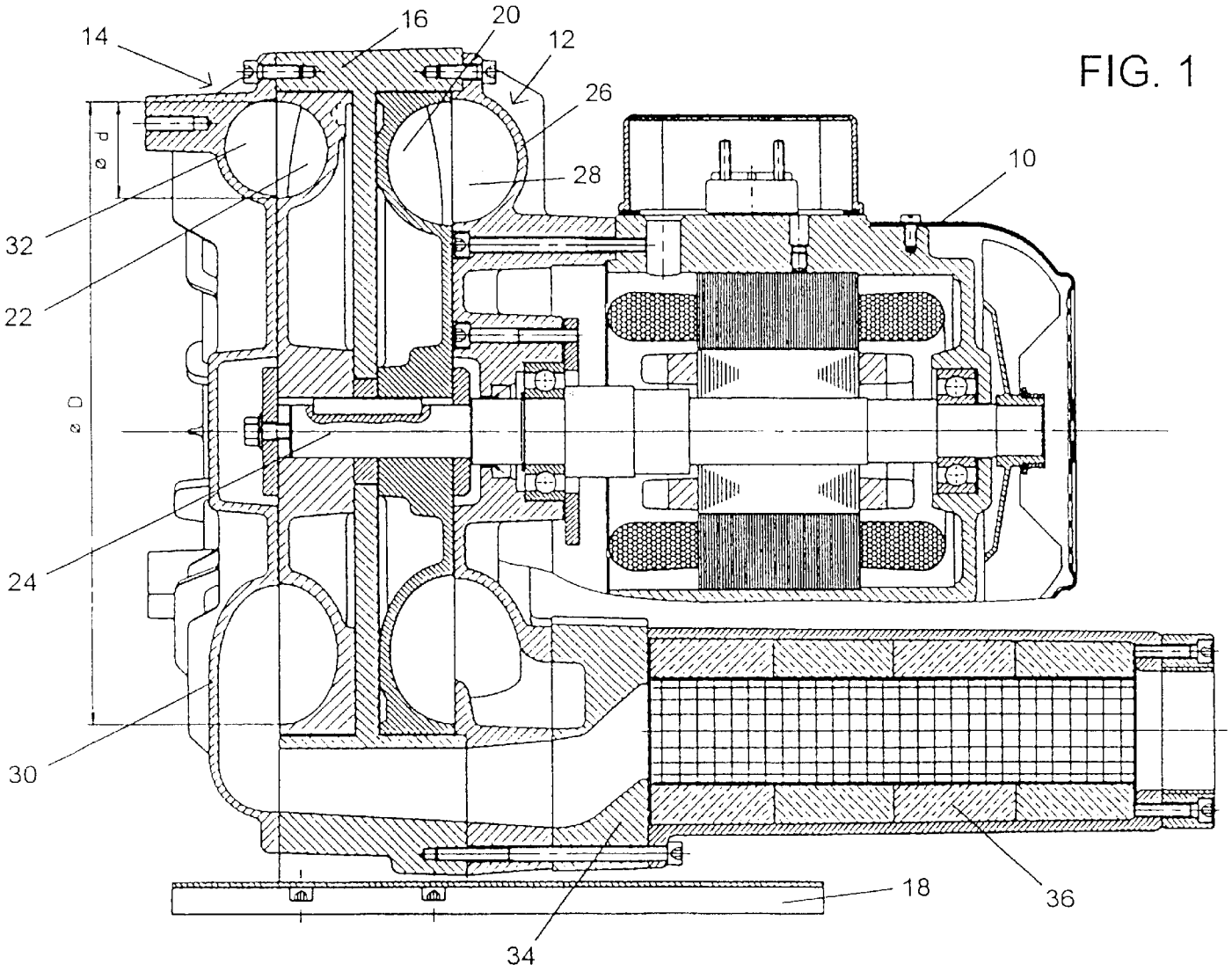
FIG. 1—an axial sectional view of a first embodiment of the multi-stage side channel pump.

In the embodiment of a multi-stage side channel pump depicted in FIG. 1, a drive motor 10, a first stage 12 and a second stage 14 are integrated into a modular unit. A housing 16 that is shared by both stages 12, 14 is mounted on a base 18. The impellers 20, 22 of the two stages 12, 14 are attached to a shared drive shaft 24 that is directly connected to the impeller of the drive motor 10. On the side of the drive motor 10, a first housing cover 26 is screwed onto the housing 16 in which the side channel 28 of the first stage 12 is shaped. On the opposite side, a second housing cover 30 is screwed onto the housing 16 in which the side channel 32 of the second stage 14 is shaped. The inlet and outlet of the second stage 14 lead through channels in the housing 16 and in the first housing cover 26 to a connection plate 34, which is described separately with reference to FIGS. 5 through 12. Moreover, the inlet and outlet of the multi-stage side channel pump pass through a sound absorber 36.

The two stages 12, 14 have different dimensions. In the first stage 12, the medium is compressed between the inlet and the outlet, so that the specific volume (reciprocal value of the density) decreases accordingly. The medium then acquires a smaller volume. The second stage 14 is adapted to this reduced volume. In order to determine the geometry of the second stage 14, first of all, the required final pressure is uniformly divided over both stages 12, 14 so that the stage pressure of both stages is the same. Then, the volume ratio of both stages 12, 14 is derived from the relationship for the adiabatic curve as described above. The resultant volume ratio is then employed to calculate the impeller geometry of the second stage, assuming geometric similarity. The decisive parameters for this purpose are the impeller outer diameter D and the flow channel diameter d (FIG. 1). The dimensioning according to the invention of the stages of the side channel pump optimizes its efficiency since the size of each impeller is adapted to the volume of the medium.

Figures 5, 6, 7, 8, 9, 10, 11, 12:
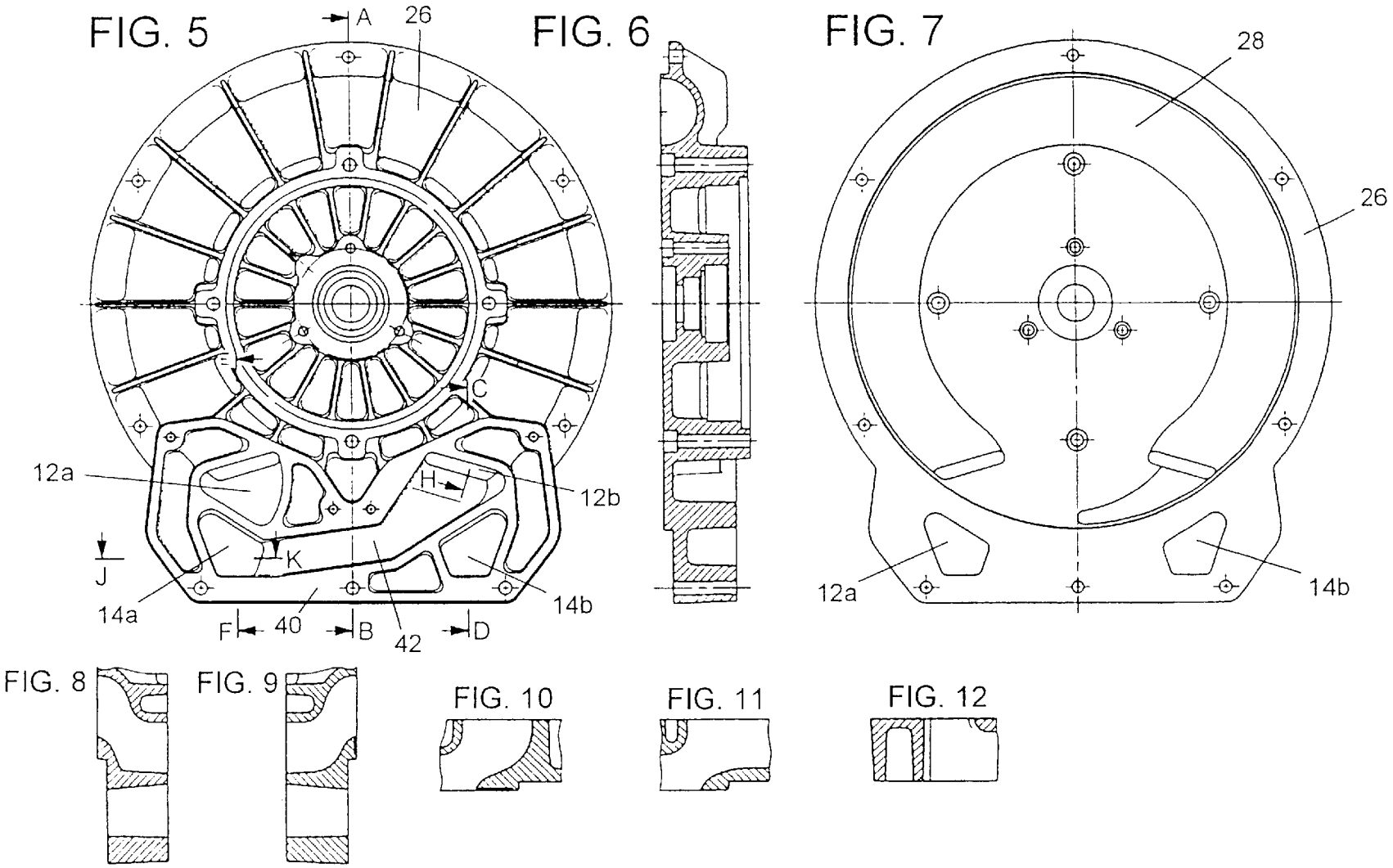
FIG. 5—a top view of a housing cover in the first embodiment of the side channel pump.
FIG. 6—a radial section of the housing cover depicted in FIG. 5.
FIG. 7—a top view of the inside of the housing cover according to FIG. 5.
FIGS. 8 through 12—various partial sections according to the sectional lines in FIG. 5.
Figure 17:
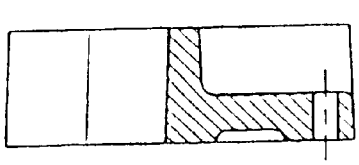
FIGS. 15 through 19—sectional views according to the sectional lines in FIG. 13.
Figure 16:
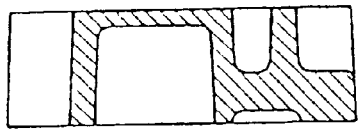
Figure 15:
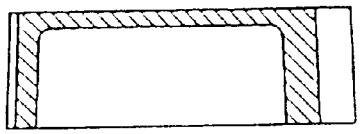
Figure 19:
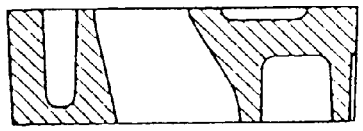
Figure 18:
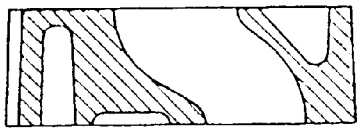
Figure 13:
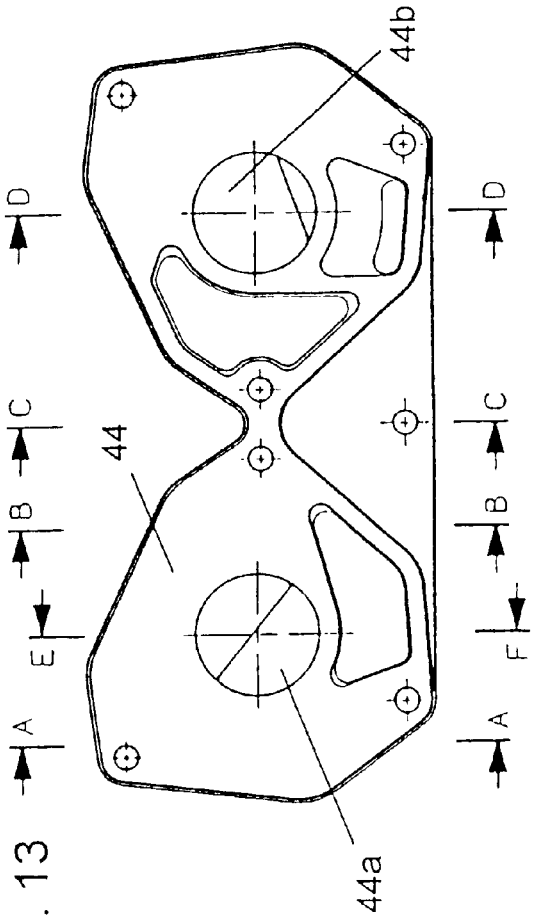
FIG. 13—a top view of a connection plate for the first embodiment of the side channel pump.
Figure 14:
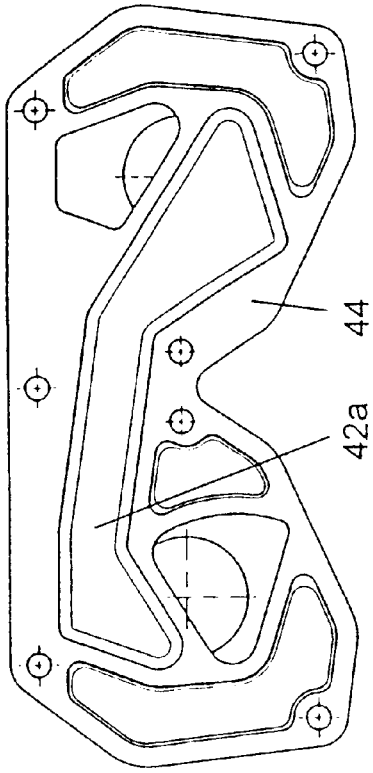
FIG. 14—a top view of the inside of the connection plate according to FIG. 13.

As can be seen in FIG. 5, the inlet 12*a* and the outlet 12*b* of the first stage and the inlet 14*a* and the outlet 14*b* of the second stage lead to the outside at a connection surface 40 on the bottom of the housing cover 26. A connection plate 44 shown in FIGS. 13 through 19 is placed onto the connection surface 40. This connection plate 44 is provided with an inlet 44*a* and an outlet 44*b*. A part 42*a* of the channel 42 is integrated into the connection plate 44.

Since, in the embodiment described, the inlets and outlets lead to the outside separately at the connection surface, the two stages 12, 14 can be combined with each other in the desired manner through the design of the connection plate 44.

Figure 2:
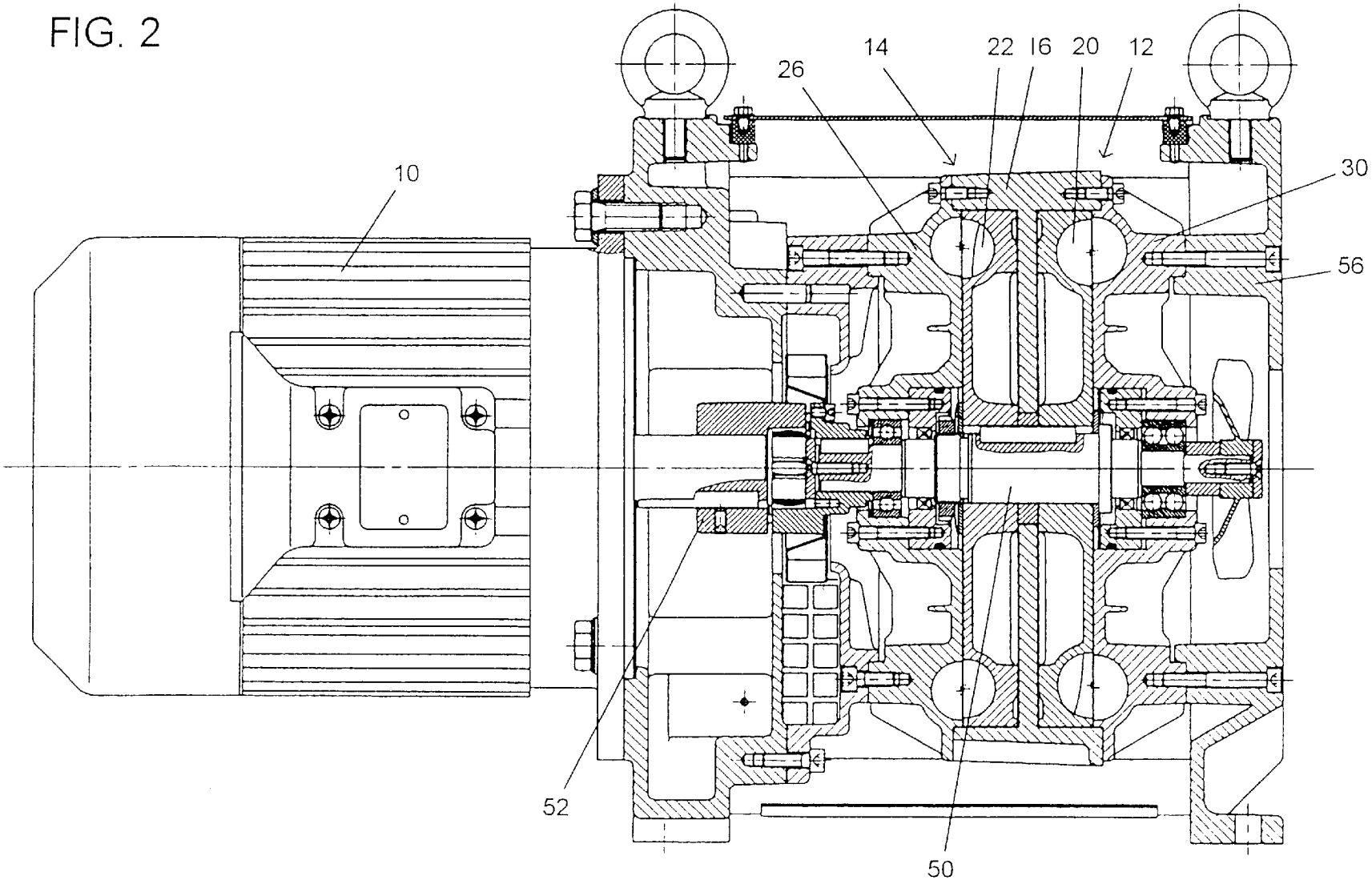
FIG. 2—an axial section of a second embodiment of the side channel pump.

In the embodiment shown in FIG. 2, the two stages 12, 14 are combined in the housing 16 with the housing covers 26, 30 and with the impellers 20, 22 on a shared shaft segment 50 so as to form a modular unit. On the surface that faces the drive motor 10, the housing cover 26 is shaped as a flange and can then be screwed onto the drive motor 10 by means of an appropriately designed connecting flange. The shaft segment 50 is connected directly to the impeller of drive motor 10 by a coupler 52. A fan 54 is connected to the end of the shaft segment 50 facing away from the drive motor 10. The housing cover 30 is also designed with a connecting flange. In the embodiment shown in FIG. 2, this flange is joined to a housing part 56 that is a component of the supporting structure of the multi-stage side channel pump.

In the embodiment shown in FIG. 3, two modular units A, B of the type described in greater detail with reference to FIG. 2 each have two stages, whereby modular unit A is flanged onto the drive motor 10 while modular unit B is flanged onto modular unit A; the shaft segment 50*a* is connected via a coupler 52*a* to the drive motor 10 while the shaft segment 50*b* is connected to the shaft segment 50*a* via a coupler 52*b*.

With all of the embodiments described, in each stage, the impeller geometry is adapted to the specific volume of the medium, as previously described in detail with reference to FIG. 1.

Figure 3:
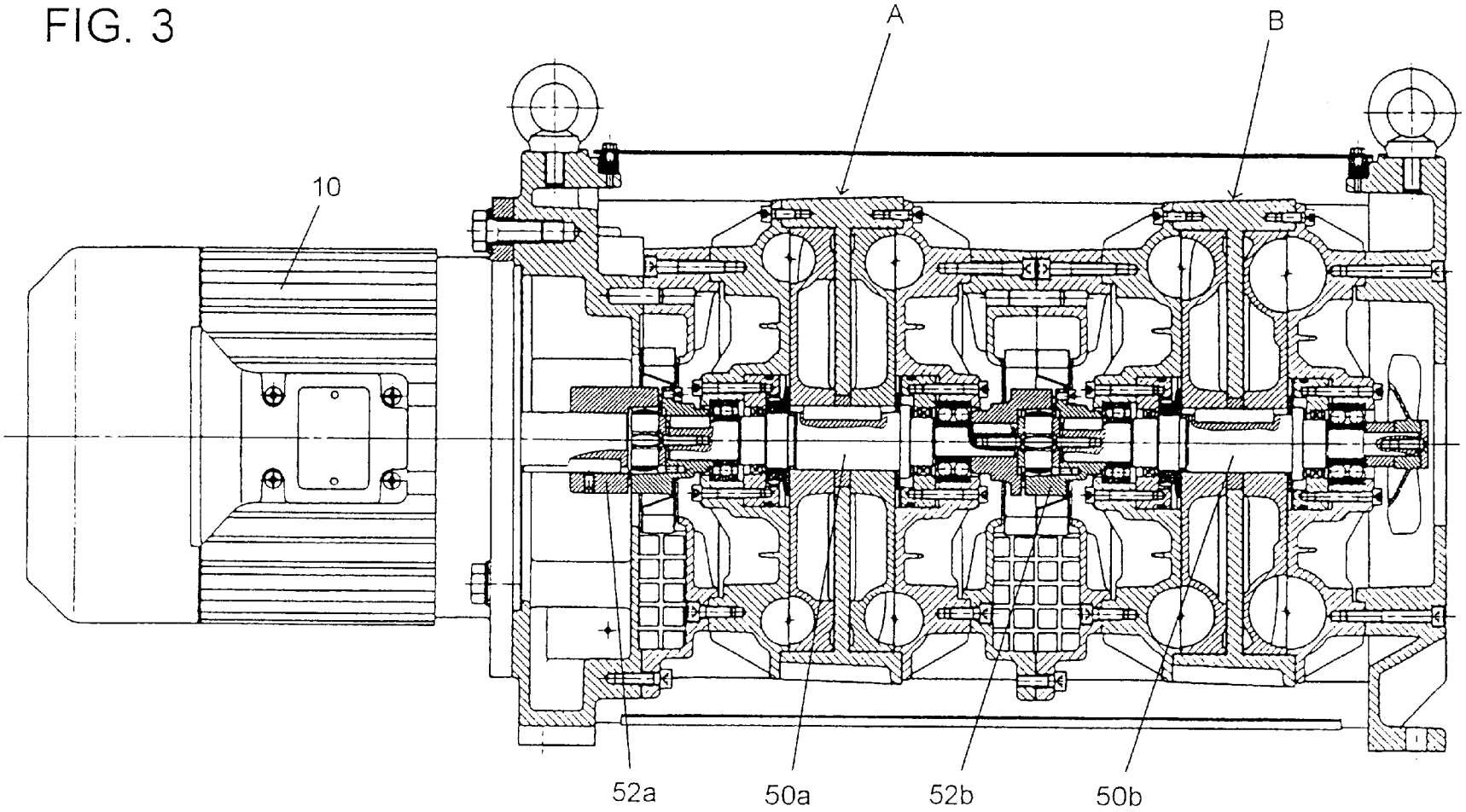
FIG. 3—a third embodiment of the side channel pump in an axial section.
Figure 4:
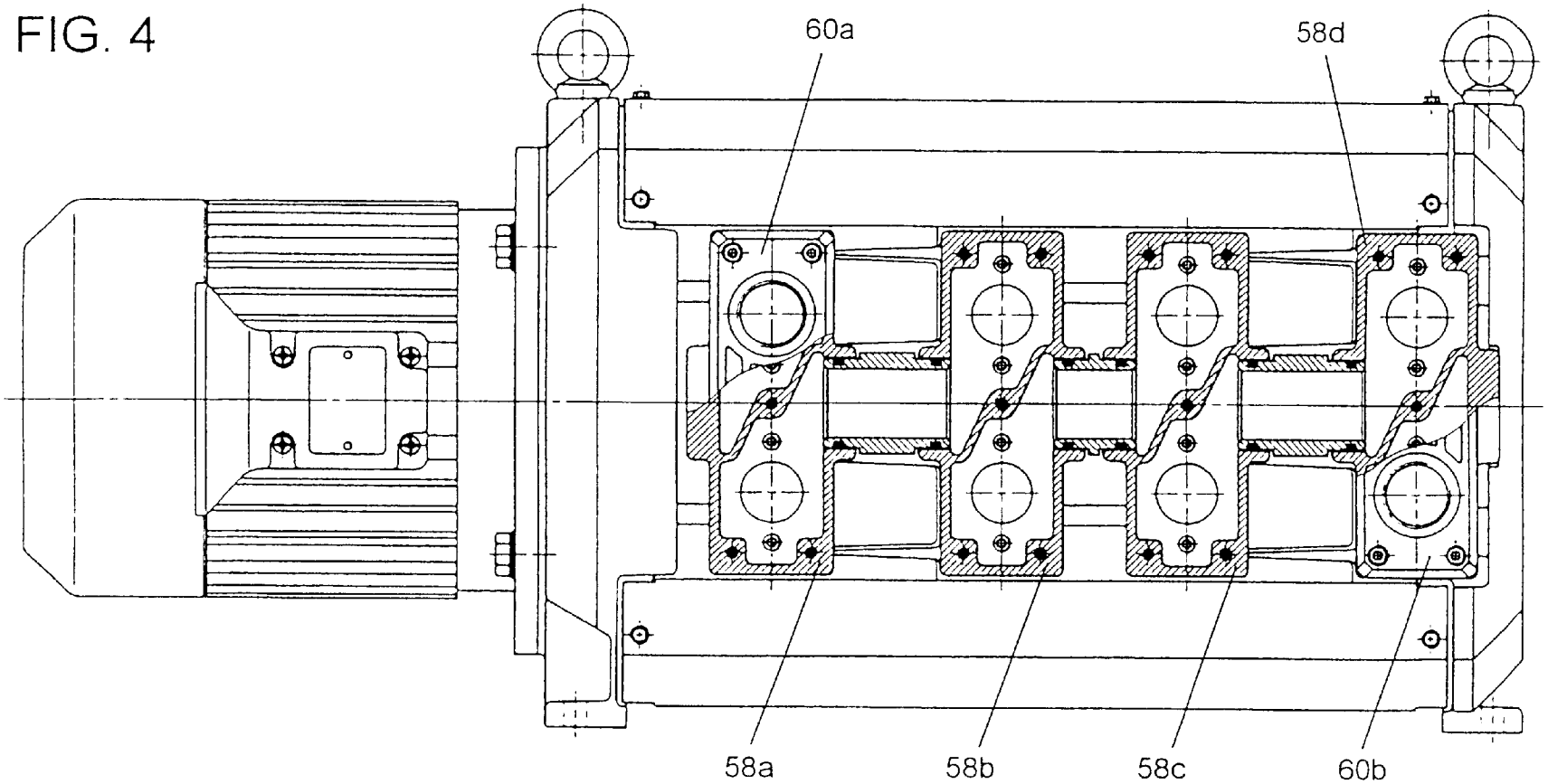
FIG. 4—a partially sectioned lateral view of the side channel pump according to the third embodiment.

In the case of the embodiments shown in FIGS. 3 and 4, the inlets and outlets of each stage lead to the outside separately at the side. The inlet and outlet of each stage are accessible at a lateral connection surface 58*a*, 58*b*, 58*c* and 58*d*. A connection plate is mounted on each of these connection surfaces 58*a* through 58*d*; FIG. 4 shows sectional views of two of these connection plates 60*a* and 60*b*. As a result of the inlets and outlets, which lead to the outside separately at the side for each stage in this embodiment, the stages can be combined with each other in many different ways, and can optionally also be operated independently of each other.

What is claimed is:

1. A multi-stage side channel pump whose impellers (20, 22) are coupled to a shared drive shaft (24), wherein the geometry of each stage (12, 14) is adapted to the specific volume of the medium at its inlet by determining the dimensions of the impeller diameter (D) and of the flow channel diameter (d) and wherein the stage pressure p for each stage (12, 14) is calculated on the basis of the required final pressure $p_{final}$ and the number n of stages according to the following relationship:

$$p=(p_{final})^{1/n}.$$

2. A side channel pump according to claim 1, wherein the impeller geometry of each next stage (14) is determined by means of the volume ratio of the preceding stage (12) to the next stage (14), assuming geometric similarity.

3. A side channel pump according to one of claims 1 through 2, wherein the stages (12, 14) are integrated with a drive motor (10) into a modular unit, whereby the impellers (20, 22) of all stages are attached to the shared drive shaft (24).

4. A side channel pump according to one of claims 1 through 2, wherein one of the stages (14) can be flanged onto a shared drive unit (10) and another stage (12) can be flanged onto the first stage (14), whereby the impeller (22) of the first stage (14) is coupled to the drive unit (10) via a coupler (52) and the impeller (20) of the other stage (12) is coupled to the impeller of the first stage via a coupler (52).

5. A side channel pump according to one of claims 1 through 2, wherein, in each case, two stages (12, 14) are combined in a housing (16) to form a structural component (A, B) wherein the impellers (20, 22) are attached to a joint shaft segment (50), in that the housing (16) of a structural component (A) can be flanged onto a shared drive unit (10) and another structural component (B) can be flanged onto the first structural component (A), and in that the shaft segments (50*a*, 50*b*) of the structural components (A, B) are coupled to each other or to the drive shaft of the drive unit (10) via a coupler (52*a*, 52*b*).

6. A side channel pump according to one of claims 1 through 2, wherein, the inlets (12*a*, 14*a*) and the outlets (12*b*, 14*b*) of the stages (12, 14) lead to the outside separately.

7. A side channel pump according to one of claims 1 through 2, wherein, leading from two stages (12, 14) that have been combined to form a modular unit, the inlets (12*a*, 14*a*) and the outlets (12*b*, 14*b*) lead to the outside separately to a shared connection interface (40).

8. A side channel pump according to claim 7, wherein, on the shared connection interface (40), the outlet (12*b*) of a stage (12) is directly coupled to the inlet (14*a*) of the next stage (14).

9. A side channel pump according to claim 7, including a connection plate (44), in which connecting channels (42*a,* 44*a,* 44*b*) have been shaped, joined to the connection interface (40).

10. A side channel pump according to claim 7, wherein the connection interfaces (58*a,* 58*b,* 58*c,* 58*d*) of several consecutive stages are arranged at the side.

11. A multi-stage side channel pump whose impellers (20, 22) are coupled to a shared drive shaft (24), wherein the geometry of each stage (12, 14) is adapted to the specific volume of the medium at its inlet by determining the dimensions of the impeller diameter (D) and of the flow channel diameter (d) and wherein one of the stages (14) can be flanged onto a shared drive unit (10) and another stage (12) can be flanged onto the first stage (14), whereby the impeller (22) of the first stage (14) is coupled to the drive unit (10) via a coupler (52) and the impeller (20) of the other stage (12) is coupled to the impeller of the first stage via a coupler (52).

* * * * *